US008247973B2

(12) United States Patent
Panyik et al.

(10) Patent No.: US 8,247,973 B2
(45) Date of Patent: Aug. 21, 2012

(54) DISCHARGE CHAMBER FOR HIGH INTENSITY DISCHARGE LAMP

(75) Inventors: Tamas Panyik, Budapest (HU); Agoston Boroczki, Budapest (HU); Istvan Csanyi, Dunakeszi (HU); Csaba Horvath, Budapest (HU)

(73) Assignee: General Electric Company, Schenectady, NY (US)

( * ) Notice: Subject to any disclaimer, the term of this patent is extended or adjusted under 35 U.S.C. 154(b) by 97 days.

(21) Appl. No.: 12/793,494

(22) Filed: Jun. 3, 2010

(65) Prior Publication Data

US 2011/0298368 A1 Dec. 8, 2011

(51) Int. Cl.
*H01J 17/16* (2012.01)

(52) U.S. Cl. ..... 313/634; 313/493

(58) Field of Classification Search ..... 313/493, 313/634

See application file for complete search history.

(56) References Cited

U.S. PATENT DOCUMENTS

| | | | |
|---|---|---|---|
| 3,885,181 | A | 5/1975 | Nelson et al. |
| 4,387,067 | A | 6/1983 | Kobayashi |
| 6,815,889 | B2 | 11/2004 | Haacke et al. |
| 7,348,731 | B2 | 3/2008 | Haacke et al. |
| 2003/0098653 | A1 | 5/2003 | Haacke |
| 2005/0116608 | A1 | 6/2005 | Haacke et al. |
| 2006/0119273 | A1 | 6/2006 | Nakazato |
| 2006/0255742 | A1 | 11/2006 | Haacke et al. |

FOREIGN PATENT DOCUMENTS

| | | | |
|---|---|---|---|
| EP | 1 174 904 | A1 | 1/2002 |
| JP | 2007179975 | A | 7/2007 |

OTHER PUBLICATIONS

PCT Invitation to pay additional fees issued in connection with corresponding WO Patent Application No. US11/38502 filed on May 31, 2011.

PCT Search Report issued in connection with corresponding WO Patent Application No. US2011/038502 filed on May 31, 2011.

*Primary Examiner* — Vip Patel
(74) *Attorney, Agent, or Firm* — Fay Sharpe LLP

(57) ABSTRACT

A high intensity discharge light source includes an arc tube having a longitudinal axis and discharge chamber formed therein. The light source includes first and second electrodes having inner terminal ends spaced from one another along the longitudinal axis. Each electrode extends at least partially into the discharge chamber. The discharge chamber is deformed so that its internal geometry is substantially rotationally asymmetric about its longitudinal axis, and is substantially mirror-symmetric relative to a plane spanned by the longitudinal axis and by another transverse axis that is perpendicular to the longitudinal axis and is vertical in a horizontal arc tube orientation, as well as substantially mirror-symmetric relative to a central plane perpendicular to the longitudinal axis. In a preferred embodiment of the disclosure the discharge lamp is of a single ended construction and the arc tube of the lamp is of double ended configuration, the discharge lamp having proximal and distal end electric lead wires to connect the arc tube to the lamp base, and the distal end electric lead wire is running below and parallel to the longitudinal discharge chamber axis in a horizontal lamp orientation, and its lateral direction coincides with the lateral direction of the central convex portion of the laterally complex concave-convex-concave deformed surface portion all along the longitudinal axis of the discharge chamber.

13 Claims, 2 Drawing Sheets

DISCHARGE CHAMBER FOR HIGH INTENSITY DISCHARGE LAMP

BACKGROUND OF THE DISCLOSURE

Reference is made to commonly owned, co-pending U.S. patent applications Ser. No. 12/793,398, filed Jun. 3, 2010, Ser. No. 12/793,441, filed Jun. 3, 2010, and Ser. No. 12/793,470, filed Jun. 3, 2010.

The present disclosure relates to a discharge chamber for a compact high intensity discharge lamp, and more specifically to a compact metal halide lamp made of translucent, transparent, or substantially transparent quartz glass, hard glass, or ceramic discharge chamber materials. Compact arc discharge lamps find particular application, for example, in the automotive lighting field, although it will be appreciated that selected aspects may find application in related discharge lamp environments for general lighting encountering similar issues with regard to salt pool location and maximizing luminous flux emitted from the lamp assembly. For purposes of the present disclosure, a "discharge chamber" refers to that part of a discharge lamp where the arc discharge is running, while the term "arc tube" represents that minimal structural assembly of the discharge lamp that is required to generate light by exciting an electric arc discharge in the discharge chamber. An arc tube also contains the pinch seals with the molybdenum foils and outer leads (in the case of quartz arc tubes) or the ceramic protruded end plugs or ceramic legs with the seal glass seal portions and outer leads (in case of ceramic arc tubes) which ensure vacuum tightness of the discharge chamber plus the possibility to electrically connect the electrodes in the discharge chamber to the outside driving electrical components via the outer leads pointing out of the seal portions of the arc tube assembly.

High intensity metal halide discharge lamps produce light by ionizing a fill, such as a mixture of metal halides, mercury or its replacing buffer alternative, and an inert gas such as neon, argon, krypton or xenon or a mixture of thereof with an arc passing between two electrodes that extend in most cases at the opposite ends into a discharge chamber and energize the fill in the discharge chamber. The electrodes and the fill are sealed within the translucent, transparent, or substantially transparent discharge chamber which maintains a desired pressure of the energized fill and allows the emitted light to pass through. The fill (also known as "dose") emits visible electromagnetic radiation (that is, light) with a desired spectral power density distribution (spectrum) in response to being vaporized and excited by the arc. For example, rare earth metal halides provide spectral power density distributions that offer a broad choice of high quality spectral properties, including color temperature, color rendering, and luminous efficacy.

In current high intensity metal halide discharge lamps, for example in automotive gas discharge lamps, a molten metal halide salt pool of overdosed quantity typically resides in a central bottom location or portion of a generally ellipsoidal or tubular discharge chamber, when the discharge chamber is disposed in a horizontal orientation during operation. Since location of the molten salt pool is always at the coldest part of the discharge chamber, this location or spot is often referred to as a "cold spot" of the discharge chamber. The overdosed molten metal halide salt pool that is in thermal equilibrium with its saturated vapor developed above the dose pool within the discharge chamber and is located inside the discharge chamber of the lamp at the cold spot, forms a thin liquid film layer on a significant portion of an inner surface of the discharge chamber wall. In this position, the dose pool distorts a spatial intensity distribution of the lamp by increasing light absorption and light scattering in directions where the dose pool is located within the discharge chamber. Moreover, the dose pool alters the color hue of light that passes through the thin liquid film of the dose pool.

Still another consideration is the impact of the electric lead wires in a lamp assembly which are for creating electrical contact between the electrodes in the discharge chamber and the electrical contacting points on the lamp base or cap. These electric lead wires of the lamp assembly can either be extended portions of the outer leads pointing out of the seal area of the arc tube assembly, or additional metal wires firmly connected to these outer leads of the arc tube assembly. In a single ended arc discharge lamp with double ended arc tube construction, one of the electric lead wires is much longer than that of the other one, and extends generally parallel all along a length of the arc tube from a proximal end to a distal end of the arc tube as seen from the lamp base in order to mechanically and electrically connect the lamp base with a distal seal portion of the arc tube. For the purposes of the present disclosure "single ended lamp" means a lamp that has a single base including both electrical contacting points of the lamp and placed at a specific single end portion of the lamp while "double ended arc tube" means an arc tube with its two electrodes located at the opposite ends of the discharge chamber. This specified distal end electric lead wire connecting to the distal end of the arc tube also has a strong shading effect on the light emitted by the arc discharge since light rays directed toward this distal end electric lead wire are either absorbed or scattered by this distal end electric lead wire. There exist arc discharge lamp constructions where this distal end electric lead wire runs outside the protective outer envelope surrounding the arc tube of the lamp and is often covered by a tube of electrically insulating material against arcing between this distal end electric lead wire and the surrounding. In such cases, degree of light blocking is exaggerated by increased effective diameter of the distal end electric lead wire due to its insulating tube cover. Because of the inevitable need to also provide the distal end electric lead wire to electrically connect the distal end of the lamp to its base, this impact of the distal end lead wire on the light output from the arc tube is usually unavoidable in known arc discharge lamps.

Optical designers who design beam forming optical systems and reflector arrangements around these types of high intensity discharge lamps that employ the described lamp, arc tube assembly and discharge chamber arrangement must recognize and accommodate both issues caused by the liquid dose pool distributed on the inner surface of discharge chamber wall and the distal end electric lead wire extending generally in parallel relation to and all along the longitudinal axis of the arc tube assembly. That is, construction of the optical system must address spatial light intensity distribution distortion, discoloration of light rays and all other light quality degradation effects in these lamps. For example, in the past and even in contemporary automotive headlamp constructions, the distorted light rays were either blocked out, by non-transparent metal shields, or the light rays were distributed evenly in directions that were not critical for the application. In other words, these distorted rays passing through the liquid dose pool were generally ignored. As such, this portion of the emitted light represents losses in the optical system as the distorted rays did not take part in forming the main beam of the projecting optical system.

In an automotive headlamp application, for example, the distorted rays are used for slightly illuminating the road immediately preceding the automotive vehicle, or the distorted light rays are directed to road sips placed well above the road. Due to these losses, efficiency of the optical systems is typically no higher than approximately 40% to 50%.

As compact discharge lamps become smaller in wattage and additionally adopt reduced geometrical dimensions, a solution is required with the light source in order to avoid such optical losses in the optical assembly or system. An improved optical system equipped with discharge lamps of improved beam characteristics would desirably achieve higher illumination levels along with lower energy consumption of the overall lighting system.

Thus, a need exists to address the issues associated with the dose pool in the discharge chamber and the distal end electric lead wire of the lamp, and their impact on performance and efficiency of the optical system designed around the lamp as a result of the uneven and distorted spatial and colorimetric light intensity distribution emitted by lamp.

SUMMARY OF THE DISCLOSURE

In an exemplary embodiment, a high intensity arc discharge lamp, for example an automotive discharge lamp, includes an arc tube with a substantially light transmissive discharge chamber at its center portion enclosing a discharge chamber volume. The lamp further includes first and second electrodes at least partially received in the discharge chamber and separated along the longitudinal axis by an arc gap. The discharge chamber of the lamp is substantially rotationally asymmetric about the usually horizontal longitudinal axis but is substantially mirror-symmetric relative to the usually vertical plane located substantially halfway along the arc gap and perpendicular to the longitudinal axis and also substantially mirror-symmetric relative to the second usually vertical plane containing the longitudinal axis. The lamp further includes in its discharge chamber wall a central portion that in horizontal orientation forms a lower side of the discharge chamber and is deformed inwardly to form two generally concave wall surface portions surrounding a generally convex portion extending along the longitudinal axis of the discharge chamber as an axial channel at the bottom of the chamber. As a result of this distorted arc chamber construction this lower central portion of the discharge chamber is preferably of a generally convex configuration along the longitudinal axis and of a complex surface configuration in a lateral direction consisting of generally concave-convex-concave portions.

The said high intensity arc discharge lamp is of a single ended construction with its base for electrical and mechanical contacting positioned at one end of the lamp, and the arc tube of the lamp is of a double ended configuration having proximal and a distal end electric lead wires as seen from the lamp base to electrically and mechanically connect the proximal and distal ends of the arc tube to the lamp base. The distal end electric lead wire furthermore extends parallel to the longitudinal axis of the discharge chamber, and in horizontal lamp orientation is displaced below the discharge chamber at exactly the same lateral direction that coincides with the lateral direction of the generally convex axial channel containing the major part of the liquid dose pool and formed by the laterally complex generally concave-convex-concave surface configuration at the bottom of the discharge chamber.

A method of controlling the location of a cold spot in a single ended arc discharge light source includes providing an arc tube of double ended configuration having a longitudinal axis in a discharge chamber formed therein. The method further includes orienting first and second electrodes having inner terminal ends spaced from one another along the longitudinal axis and extending each electrode at least partially into the discharge chamber. The method further includes forming the discharge chamber to be rotationally asymmetric about the longitudinal axis.

A primary benefit of the present disclosure is a controlled location of a metal halide salt pool in a compact high intensity discharge chamber.

Another benefit is that the dose pool with its shading area laterally coinciding with the shading area of the distal electric lead wire has less impact on the light distribution, thereby resulting in the lamp being more efficient and provides a more even light distribution. In turn, optical designers can develop a more efficient beam forming optical system around the arc discharge lamp.

Still another benefit of providing a preselected liquid dose pool location in the light source is the ability to address the problem of scattered and discolored light rays.

Still other features and benefits of the present disclosure will become more apparent from reading and understanding the following detailed description.

DETAILED DESCRIPTION OF THE PREFERRED EMBODIMENTS

Figure 1:
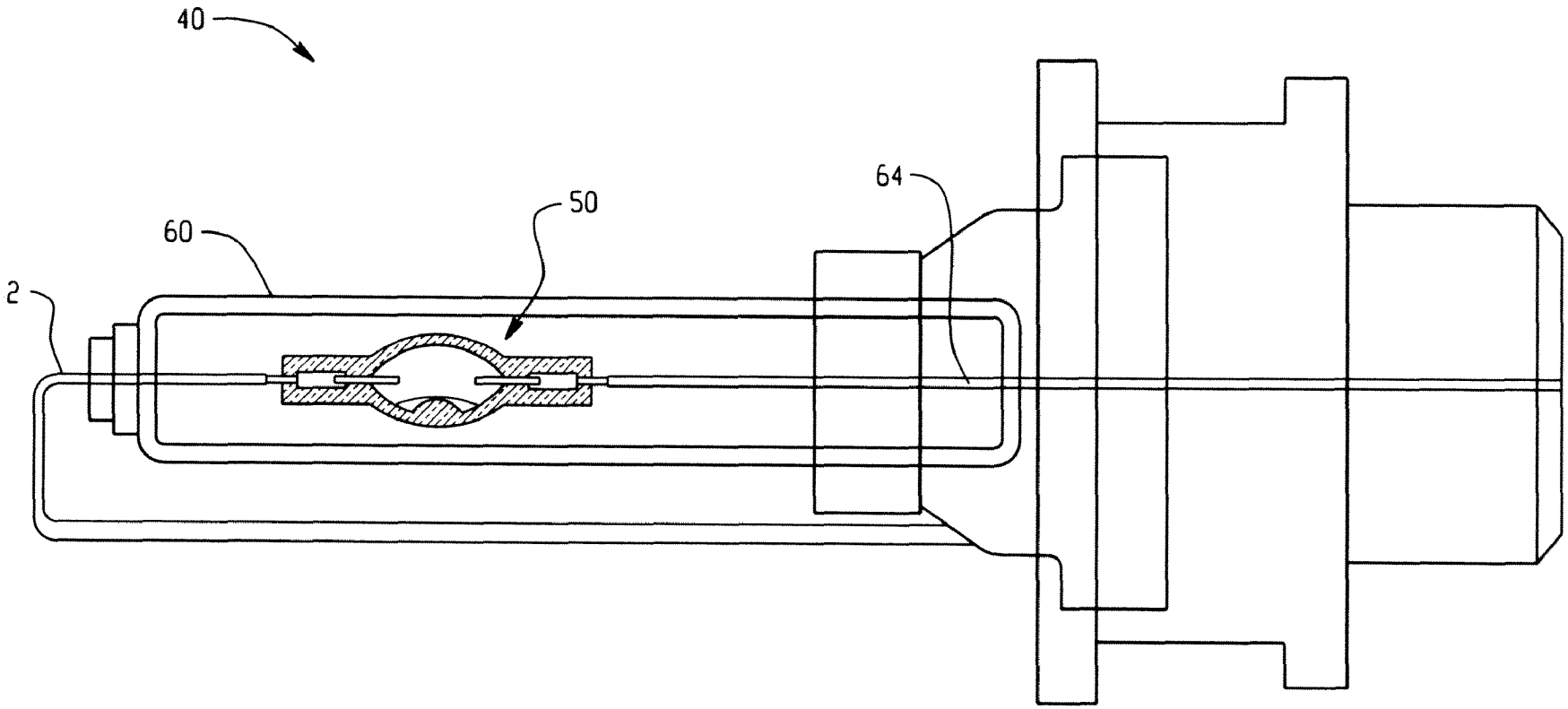
FIG. 1 is a cross-sectional view of a discharge lamp with an outer envelope according to the exemplary embodiment.

With regard to FIG. 1, a light source assembly such as a high intensity arc discharge lamp, for example a compact low wattage automotive gas discharge lamp assembly 40, incorporates an arc tube 50 as a source of light according to an exemplary embodiment of the present disclosure. The arc tube 50 is mounted in an outer envelope or outer shroud 60, and electric lead wires and/or supports 62, 64 are provided at opposite axial ends of the arc tube to mechanically support and electrically connect the arc tube to the base of the lamp assembly and finally to an external supply voltage (not shown). In this case of a single ended lamp assembly construction with double ended arc tube configuration, one of the electric lead wires (the distal end electric lead wire shown here as electric lead wire 62) extends along the length of the lamp assembly to mechanically support the distal end of the lamp and provide electrical connection thereto.

Figure 2:
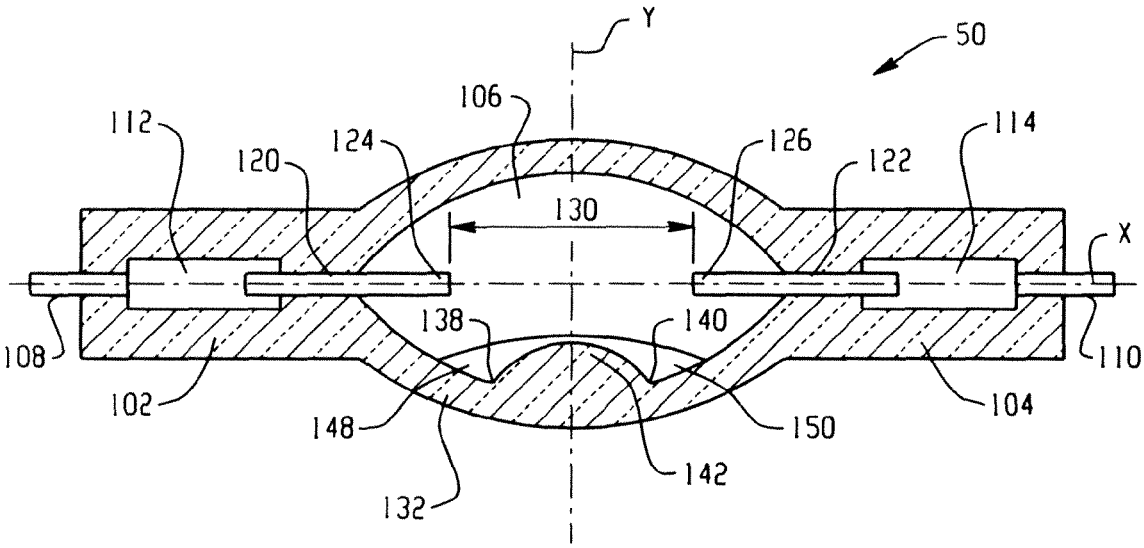
FIG. 2 is a cross-sectional view of an arc tube in accordance with the exemplary embodiment.
Figure 3:
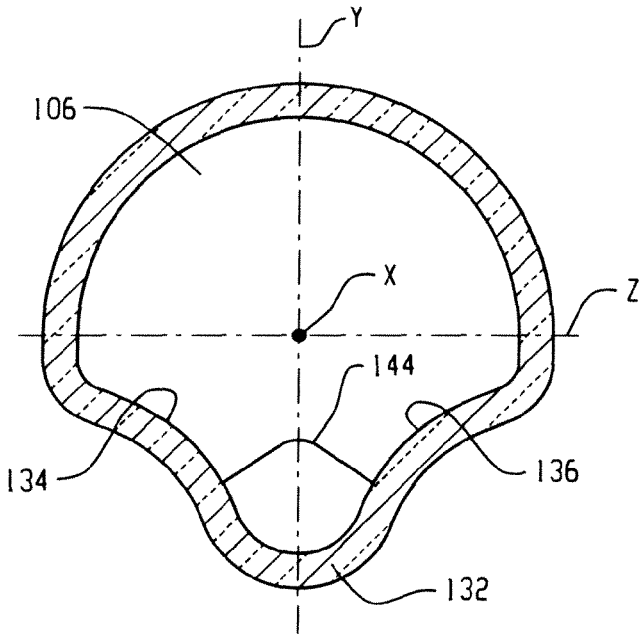
FIG. 3 is a cross-sectional view through a central region of the arc tube taken substantially perpendicular to the longitudinal axis of the lamp in FIG. 1.

Details of the arc tube incorporated into the high intensity discharge lamp, for example a compact low wattage automotive gas discharge lamp assembly shown in FIG. 1, are more particularly illustrated in FIGS. 2-3. The arc tube 50 includes first and second pinch seals or seal ends 102, 104 disposed at opposite axial ends of a central discharge chamber 106. The arc tube in this exemplary embodiment is preferably made of translucent, transparent, or substantially transparent quartz glass or hard glass discharge chamber material. Outer leads 108, 110 have outer end portions that extend outwardly from each sealed end for connection with the supports 62, 64 to form electric lead wires towards the lamp base or the outer leads are advantageously integrally formed with the supports to constitute such electric lead wires. Inner end portions of the outer leads terminate within the seal ends and mechanically and electrically interconnect with conductive plates or foils such as molybdenum foils 112, 114, respectively, for example in case of an arc tube made of fused silica (quartz glass)

material. First and second electrodes 120, 122 have axial outer ends that are likewise mechanically and electrically joined with the molybdenum foil, and include inner terminal end portions 124, 126 that at least partially extend into the discharge chamber 106. The inner terminal ends of the electrodes are separated from one another by an arc gap 130 in a direction parallel or coincident with longitudinal axis "X" of the discharge chamber.

In response to a voltage applied between the first and second electric lead wires, an arc is formed across the arc gap 130 between the inner terminal ends 124, 126 of the electrodes. An ionizable fill material or dose is sealingly received in the discharge chamber and reaches a discharge state in response to the arc. Typically, the fill includes a mixture of metal halides. The fill may or may not include mercury as there is an ever-increasing desire to reduce the amount of mercury or entirely remove the mercury from the fill.

As described in the Background, a liquid phase portion of the ionizable fill material is usually situated in a bottom portion of a horizontally disposed discharge chamber. This dose pool adversely impacts lamp performance, light color, and has a strong shading effect that impacts the light intensity and light intensity distribution emitted from the lamp. As evident in FIG. 2, the discharge chamber is rotationally asymmetric about the longitudinal axis "X". On the other hand, the discharge chamber is preferably mirror-symmetric relative to the plane located substantially halfway along the arc gap and perpendicular to the "X" longitudinal axis, and is spanned by a usually vertical transverse axis "Y" and another usually horizontal transverse axis "Z" both being perpendicular to the longitudinal axis "X". Likewise, the discharge chamber is preferably mirror-symmetric relative to the plane spanned by the "X" longitudinal axis and the "Y" usually vertical transverse axis that is perpendicular to the "X" longitudinal axis (see FIG. 3).

More particularly, the arc tube in the exemplary embodiment has a generally ellipsoidal outer surface conformation along the longitudinal extent between the sealed ends (FIG. 2). The inner surface of the discharge chamber is also generally ellipsoidal and consequently a wall thickness of the arc tube is substantially constant about the perimeter of the discharge chamber except along a lower central portion surrounding an axial channel 132 (see FIG. 3 for reference). Specifically, opposed wall portions along the lower central portion of the discharge chamber are distorted, pressed or pinched inwardly from each side to form first and second generally concave surfaces 134, 136 and an axial channel with a generally convex lower cross sectional contour 132 extending along the "X" longitudinal axis of the discharge chamber (FIG. 3). The concave surfaces 134, 136 and the convex axial channel 132 are preferably mirror-symmetric relative to the plane spanned by the "X" and "Y" axes (but a lateral cross section of the arc chamber is asymmetric relative to the plane spanned by "X" and "Z" axes) as illustrated in FIG. 3. The distorted bottom region of the discharge chamber wall also forms substantially convex transition surfaces 138, 140 in the longitudinal direction which are disposed at axial opposite ends of a central generally concave region 142 that extends in a longitudinal direction generally parallel to the "X" axis (see FIG. 2) and that also forms substantially concave lateral transition regions like 144 at the opposite ends of the discharge chamber (FIG. 3).

As a result of the complex inner surface geometry due to the distorted portions at the lower part of the discharge chamber, and the generally thicker wall portions of the discharge chamber in these regions, first and second cold spot locations 148, 150 are formed on both sides of a lower convex axial channel portion 132 extending all along the longitudinal axis of the discharge chamber. More specifically, these cold spot locations 148, 150 are on generally opposite ends of the concave region 142 as well as of the convex axial channel 132 in the axial direction, and similar cold spot locations can also be found on opposite sides of the concave regions like 144 as well as the convex axial channel 132 in the lateral direction. In general, there are in total four such cold spot locations like 148, 150 that are formed at the bottom opposite ends of the discharge chamber. Liquid dose pools located in cold spot locations 148, 150 and in their lateral counterparts being substantially close to the end portions of the discharge chamber block only insignificant portions, if any, from the radiation emitted by the arc discharge running in the arc gap. The convex axial channel 132 formed in the bottom central portion of the discharge chamber also acts as another and usually the highest volume cold spot area of the discharge chamber and thus usually an axially extending but laterally thin molten dose pool is formed along the bottom of the discharge chamber in this convex axial channel 132. By providing a predetermined cold spot location(s), the optics designer has a controlled position where the liquid dose pool will be located and appropriate consideration is given to developing a projecting optical system arrangement that minimizes the prior art impact of light being scattered and discolored by the dose pool.

Further, as shown in FIG. 1, the elongated distal end electric lead wire 62 is preferably oriented in lateral offset relation to the longitudinal axis of the arc tube of the lamp, that is, in generally parallel relation with the longitudinal axis "X" alongside the arc tube. Because the distal end electric lead wire 62 that is located beside the liquid dose pool also creates a strong shading effect on the light output from the arc discharge lamp, it is preferable to position this distal end electric lead wire in the same outer perimeter region as occupied by the convex axial channel 132 and the four cold spot locations 148, 150 in order to align or harmonize the two different sources of shading effects. In this way the shading effect of both the dose pool and the distal end electric lead wire on the light emitted from the lamp assembly is minimized.

In summary, while both the position controlled dose pool (s) and the distal end electric lead wire still do have an impact on light output of the lamp, the dose pool and the distal end electric lead wire can be properly aligned so that light rays from the discharge chamber directed toward the dose pool are likewise directed toward the distal end electric lead wire and loss of light intensity is minimized.

It is to be noted that if a ceramic arc tube material is used, construction of seal portions of an arc tube is completely different in construction materials and geometry from the embodiments depicted in FIG. 1 and especially in FIG. 2, both of these figures showing embodiments produced by a quartz glass (fused silica) or hard glass based high intensity arc tube production technology. However, this fact does not have any serious impact on the basic concept of the present disclosure, that is constructing a discharge chamber of deformed geometry which is substantially rotationally asymmetric about its longitudinal axis, substantially mirror-symmetric relative to a central plane perpendicular to the longitudinal axis, and its lower central wall portion is preferably of a generally convex configuration along the longitudinal axis and of a complex surface configuration in a lateral direction consisting of generally concave-convex-concave portions as shown by FIG. 3. The cross sectional geometry of FIG. 3, which is at a central plane substantially perpendicular to the longitudinal axis of the arc chamber, is valid both in case of a quartz or hard glass base or a ceramic base high intensity discharge arc tube production technology.

This disclosure provides a solution of how to harmonize the shading effect of the liquid dose pool and the distal end electric lead wire of a horizontally operated single ended arc discharge lamp with double ended arc tube configuration. These effects today are added to each other, and thereby significantly decrease the efficacy of the lamp. The geometrical design in which the dose pool is axially aligned to the arc tube, and is closely parallel to the distal end electric lead wire, provides a more efficient solution than that of the present state of the art arc discharge lamps. Increased lamp efficacy is achieved by a discharge chamber design wherein one side (here, in horizontal operation, the lower side) of the discharge chamber is pressed (distorted) inwardly in symmetric fashion. In this manner, the remainder of the arc tube is unaffected while the central bottom portion is formed like a groove or ditch. Relocating the cold spot and dose pool to a different, predetermined location in the discharge chamber has less effect on the light distribution and thus makes the lamp more efficient and of more even spatial light distribution, and further allows the optical designers to develop a more efficient beam forming optical system, for example for an automotive headlamp.

The disclosure has been described with reference to the preferred embodiments. Obviously, modifications and alterations will occur to others upon reading and understanding the preceding detailed description. It is intended that the disclosure be construed as including all such modifications and alterations.

We claim:

1. A high intensity discharge light source comprising:

an arc tube having a longitudinal axis and a discharge chamber formed therein, wherein first and second central lower portions of an inner wall surface of the discharge chamber are deformed inwardly to form a complex surface having generally concave-convex-concave portions in the lateral direction and a generally concave surface at the first and second deformed portions and a generally convex surface at the portion in between the first and second deformed portions in the axial direction;

first and second electrodes having inner terminal ends spaced from one another along the longitudinal axis and each electrode extending at least partially into the discharge chamber; and the discharge chamber being substantially rotationally asymmetric about the longitudinal axis.

2. The high intensity discharge light source of claim 1 wherein a wall thickness along a length of the arc tube is substantially the same from a first end to a second end.

3. The high intensity discharge light source of claim 1 wherein the discharge chamber is substantially mirror-symmetric relative to a central plane perpendicular to the longitudinal axis of the discharge chamber.

4. The high intensity discharge light source of claim 1 wherein a central portion of the discharge chamber is substantially similar in cross-sectional dimension with the first and second ends.

5. The high intensity discharge light source of claim 1, wherein the concave-convex-concave lateral portions and the generally concave and convex axial surface are substantially rotationally asymmetric about the longitudinal axis.

6. The high intensity discharge light source of claim 1 wherein the concave-convex-concave lateral portions are substantially mirror-symmetric relative to a plane spanned by the longitudinal axis and by another transverse axis that is perpendicular to the longitudinal axis and is vertical in a horizontal arc tube orientation, and the concave and convex axial surfaces are also substantially mirror-symmetric relative to a central plane perpendicular to the longitudinal axis.

7. The high intensity discharge light source of claim 1, wherein in a horizontal arc tube orientation upper and lower sides of the discharge chamber are substantially parallel along the longitudinal axis.

8. The high intensity discharge light source of claim 1, wherein a wall thickness of the discharge chamber is substantially constant along the first and second deformed portions.

9. A high intensity discharge lamp comprising:

a light transmissive arc tube enclosing a discharge chamber;

first and second electrodes having inner terminal ends that extend into the discharge chamber and are separated by an arc gap;

the discharge chamber being substantially rotationally asymmetric about a longitudinal axis and substantially mirror-symmetric relative to a central plane perpendicular to the longitudinal axis of the discharge chamber; and wherein first and second central lower portions of an inner wall surface of the discharge chamber are deformed inwardly to form a complex surface having generally concave-convex-concave portions in the lateral direction and a generally concave surface at the first and second deformed portions and a generally convex surface at the portion in between the first and second deformed portions in the axial direction, a wall thickness of the discharge chamber being substantially constant along the first and second deformed portions.

10. The high intensity discharge lamp of claim 9 wherein the generally concave-convex-concave lateral portions and the concave and convex surface are substantially rotationally asymmetric about the longitudinal axis.

11. The high intensity discharge lamp of claim 9, wherein the generally concave-convex-concave lateral surfaces are substantially mirror-symmetric relative to a plane spanned by the longitudinal axis and by another transverse axis that is perpendicular to the longitudinal axis and is vertical in a horizontal arc tube orientation, and forming the concave and convex surfaces to be substantially mirror-symmetric relative to a central plane perpendicular to the longitudinal axis.

12. The high intensity discharge lamp of claim 9, wherein the inner wall surface of the discharge chamber is substantially convex surrounded by concave portions in the lateral direction and is substantially concave at the concave lateral portions and is substantially convex at the surrounded convex lateral portion along the longitudinal direction.

13. A high intensity discharge lamp of claim 9, wherein the discharge lamp is of a single ended construction and the arc tube of the lamp is of double ended configuration, the discharge lamp having proximal and distal end electric lead wires to mechanically and electrically connect the proximal and distal ends of the arc tube to the lamp base, and the distal end electric lead wire is running below and parallel to the longitudinal discharge chamber axis in a horizontal lamp orientation, the lateral direction of the distal end electric lead wire coinciding with the lateral direction of the central convex portion of the laterally complex concave-convex-concave deformed surface portion at the lower part of the discharge chamber all along the longitudinal axis of the discharge chamber.

* * * * *